US006296160B1

(12) United States Patent
Murray

(10) Patent No.: US 6,296,160 B1
(45) Date of Patent: Oct. 2, 2001

(54) CLOTHES HANGER

(76) Inventor: James Murray, P.O. Box 15544, Washington, DC (US) 20003

( * ) Notice: Subject to any disclaimer, the term of this patent is extended or adjusted under 35 U.S.C. 154(b) by 0 days.

(21) Appl. No.: 09/632,525

(22) Filed: Aug. 4, 2000

(51) Int. Cl.[7] ..... A47G 25/14
(52) U.S. Cl. ..... 223/88; 223/85; 223/92
(58) Field of Search ..... 223/85, 92, 93, 223/88, DIG. 1, 95

(56) References Cited

U.S. PATENT DOCUMENTS

D. 29,872 * 12/1898 Kennedy ..... 223/92
1,458,066 * 6/1923 LeCompte ..... 223/85
3,310,179 * 3/1967 Cappuzzello ..... 223/92
4,673,114 6/1987 Douglas .
5,082,152 1/1992 Chen .
5,476,199 12/1995 Halverson et al. .
5,526,968 * 6/1996 Larson ..... 223/98
5,901,888 * 5/1999 Schneider et al. ..... 223/89
5,950,884 * 9/1999 Payne ..... 223/85
6,050,462 4/2000 Petrou et al. .

* cited by examiner

*Primary Examiner*—Bibhu Mohanty
(74) *Attorney, Agent, or Firm*—John H. Dodds

(57) ABSTRACT

The present invention is an improved clothes hanger that offers the user the possibility of hanging clothes in such a manner that the back of the neck collar does not become damaged or creased, the invention also provides for ties or scarves and belts to be affixed in an efficient space saving manner.

5 Claims, 4 Drawing Sheets

CLOTHES HANGER

BACKGROUND & CROSS REFERENCES TO RELATED APPLICATIONS

This application is based upon the Information Disclosure document 403834 filed on Aug. 10, 1998.

BACKGROUND: FEDERALY SPONSORED RESEARCH

Not Applicable

REFERENCE TO MICROFICHE APPLICATION

Not Applicable

1. Background: Field of Invention

The present invention relates to an improved clothes hanger for the arrangement of clothes in an orderly fashion in such as way as to minimize creasing.

2. Background: Discussion of Prior Art

There are many types of clothes hangers on the market. An example is U.S. Pat. No. 6,050,462. However these structures that do not allow for creasing that is caused in the back of shirt collars and they do not allow for hanging accessories such as ties and belts. There is also available clothes hangers that have a cross bar usually used for the hanging of trousers. While this cross bar is often used for hanging of belt and ties, there is often a stability problem and the belt or tie will fall off to the ground. There are a range of other devices that are produced specifically for the hanging of ties and belts, these devices are however usually expensive to produce and cumbersome making them unsuitable for travel.

Known prior art garment hangers include U.S. Pat. Nos. 5,082,152; 5,476,199; 4,948,019; and 4,673,114. None of these prior art referenced claim a device for preventing creasing of collars. In this respect, the clothes hanger to the present invention substantially departs from the conventional concepts and prior art, and in doing so provides a device that is able to hang clothes in a way that is more efficient and with less garment damage.

SUMMARY

The present invention is an improved clothes hanger that offers the user the possibility of hanging clothes in such a manner that the back of the neck collar does not become damaged or creased, the invention also provides for ties or scarves and belts to be attached to the hanger, leading to efficiency of space use and ease of travel use.

OBJECTS & ADVANTAGES

The primary object of the present invention is to provide a clothes hanger that can be used in a way that prevents the collar of a garment from becoming ruffled, creased or damaged.

Another object of the invention is to allow the used to hang scarves, ties or belts on the same clothes hanger, saving both time and space.

DESCRIPTION OF DRAWINGS

The foregoing and other advantages and features of the present invention will be more clearly understood from the following detailed description and the accompanying drawings, in which, FIG. 1. Displays a side view of the invention.

DESCRIPTION OF INVENTION

Figure 1:
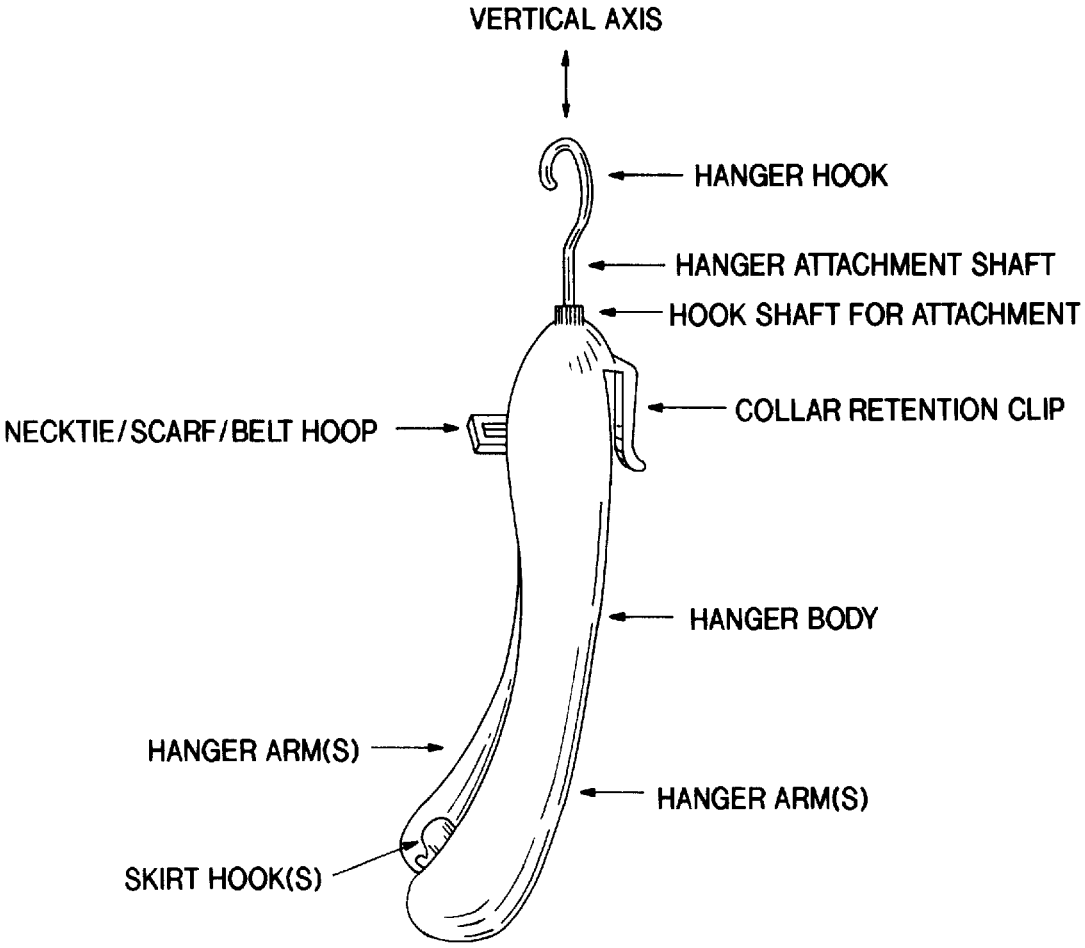
Figure 2:
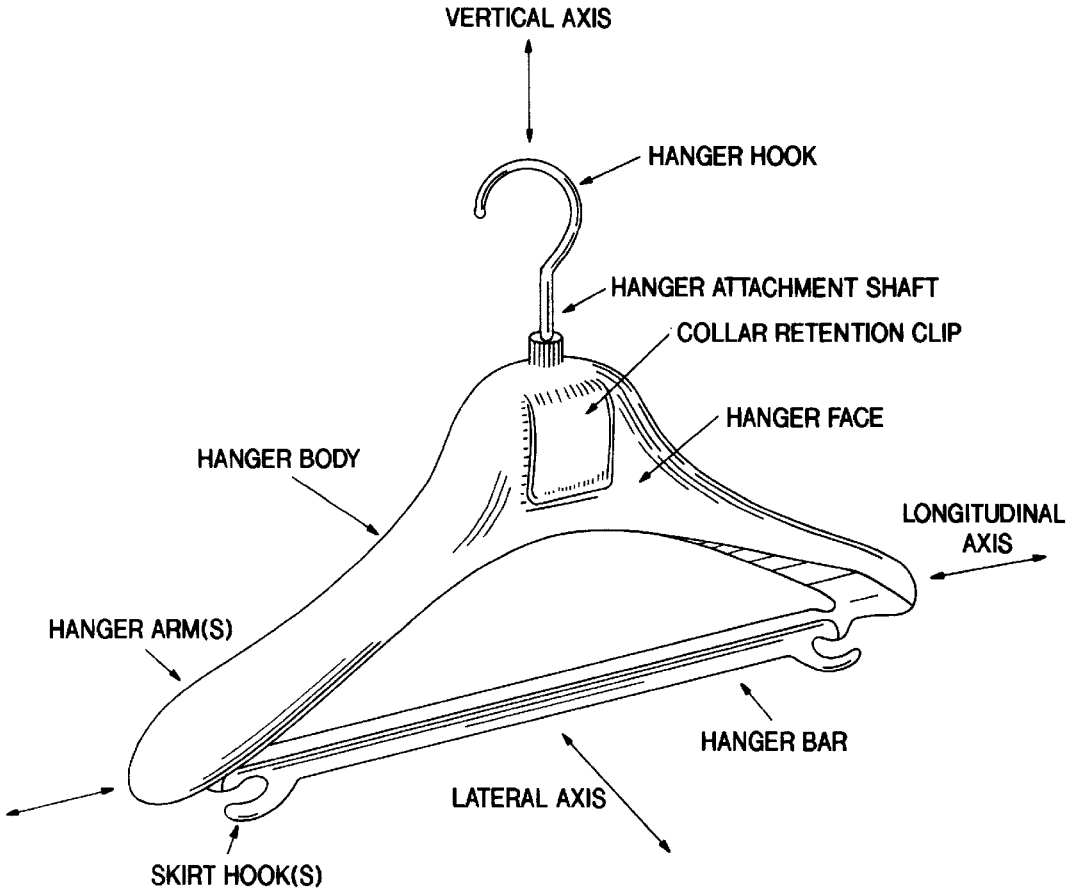
FIG. 2. Displays a back view of the invention.
Figure 3:
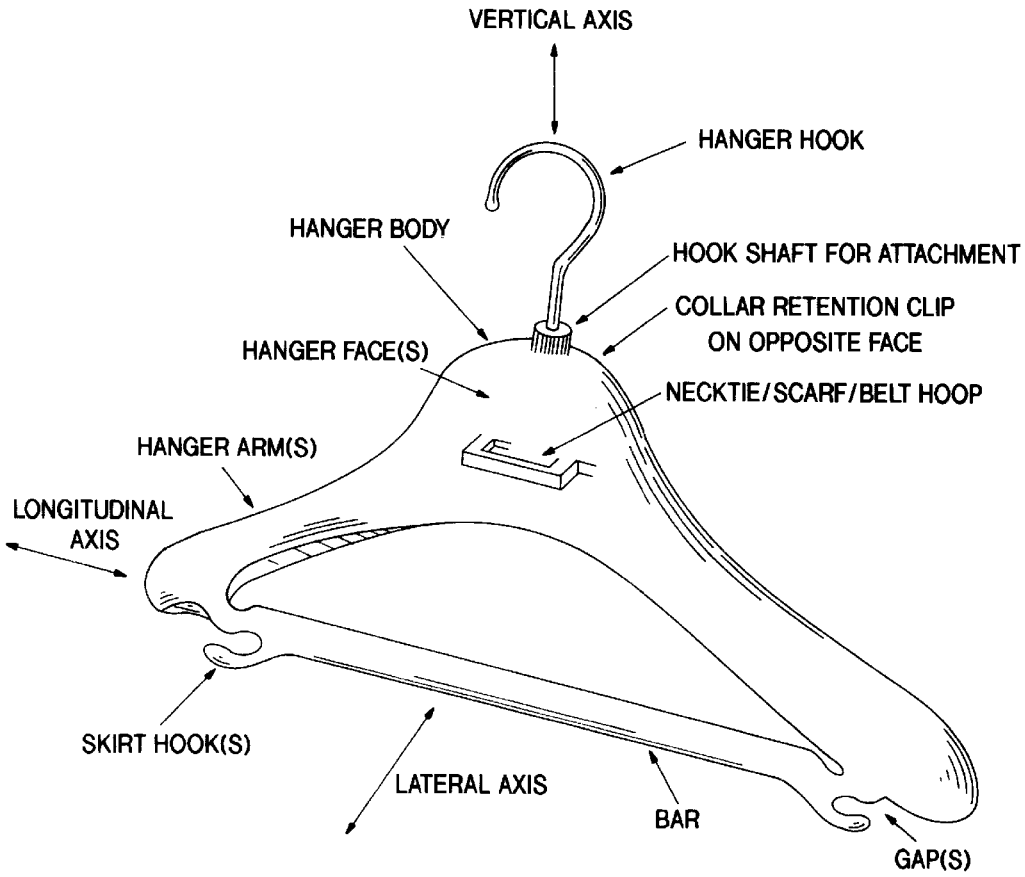
FIG. 3. Displays a front view of the invention.
Figure 4:
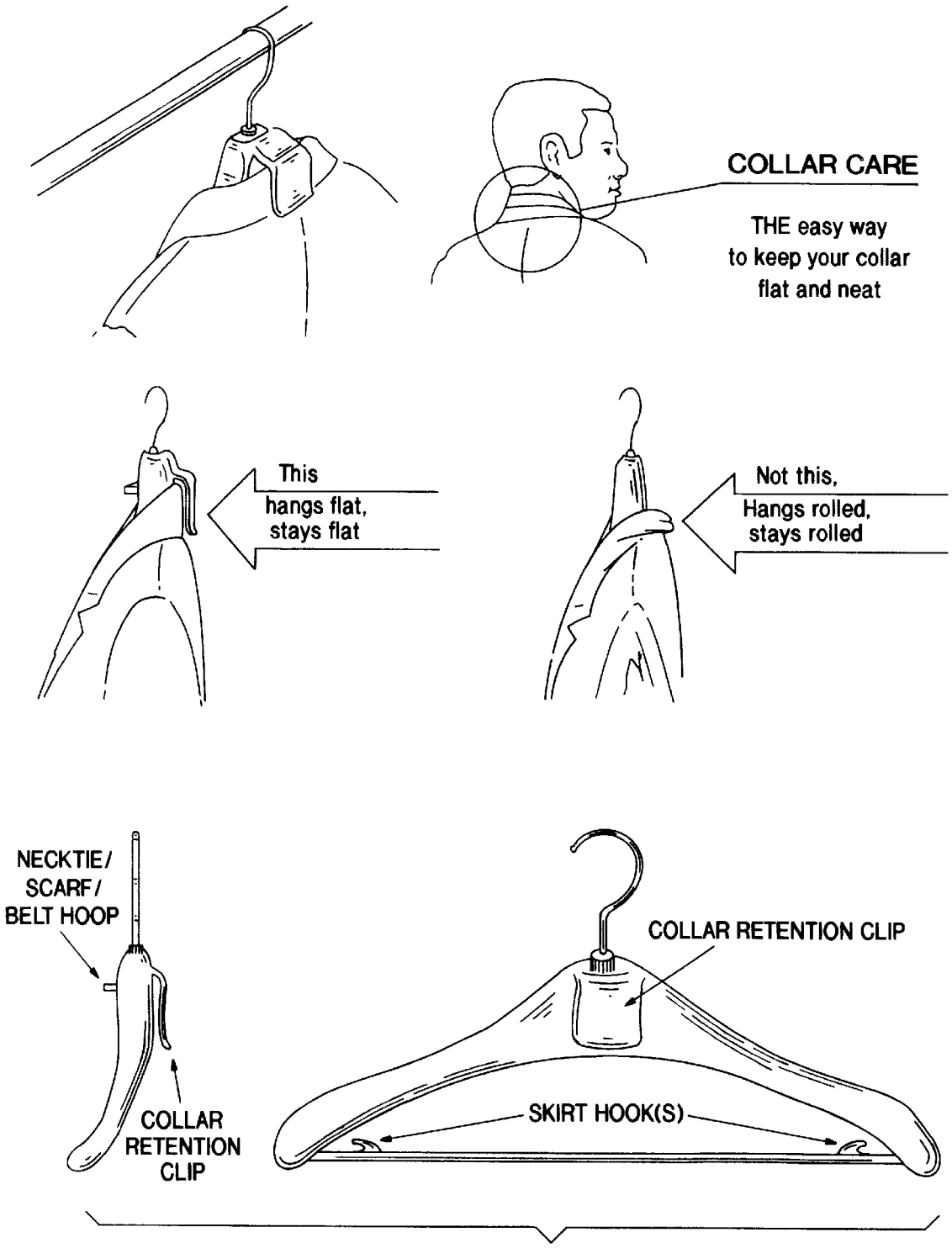
FIG. 4. Displays a schematic view of the invention showing the object use and advantage over existing art in this area.

1.—This invention comprises of a device for simultaneously hanging multiple garment items, including: coats, shirts, jackets, neckties, pants, and any other items of clothing apparel. And, maintains the collar of a shirt, coat or jacket in a property folded, upright condition.

2.—The hanger has a hook located at the top, center; which can be of any suitable size and shape, so that it may be hung on a bar, or by any other suitable fixture.

3.—The hook is attached to the hanger by any suitable means, and may be so attached as to freely rotate about the vertical axis of the hook attachment shaft.

4.—An inverted "L-shaped" collar retention clip is attached by any suitable means to one face of the hanger so that the open end faces toward the bottom end of the hanger.

5.—The collar retention clip can be of any suitable size and shape to hold the collar of a coat, shirt or jacket in a folded, upright position. It can be either elastic enough to retain the collar, or it may hold the collar by any means of flexible compression, such as a coiled spring. It may also be constructed of more than a single component. The gap shall be sufficiently narrow in order to adequately retain the collar.

6.—The clip can be attached to the face of the hanger at any suitable angle. The clip material may also be of any geometric cross-section and shape. A hole, or holes, of any size and shape may be incorporated into the clip for lightness, styling and economy of materials.

7.—A hoop of any convenient size and shape for holding neckties or other items of clothing apparel is attached to the hanger face, opposite that of the collar retention clip. The hole formed by the hoop shall be sufficient size so as to allow a necktie or other item of clothing apparel, such as a belt, socks, etc., to be threaded through the hole.

8.—The hoop is attached by any suitable means to the face of the hanger, and at any suitable angle, relative to the face of the hanger. The hoop material may also take any form of geometric cross-section, and more than one hoop of nay size, shape, and using material of any geometric cross-section, may be used; placed at any convenient location on the hanger face(s).

9.—The hanger has a horizontally mounted bar of any suitable size and shape placed between the opposite (longitudinal) ends of the hanger arms. The bar may be of any geometric cross-section.

10.—The horizontal bar is attached by any suitable means.

11.—Immediately below the bar, and immediately inside the opposite ends of the hanger arms, 2 (two) small outwardly facing horizontal hooks are provided for the attachment of a skirt. The skirt is held by the hooks, and is retained by the narrow gap clearance between the hooks and the bar or hanger arms. The ends of the hooks may also be shaped to prevent slippage by increasing the end diameter of each hook.

12.—The skirt hooks may be of any suitable size, shape, length and geometric cross-section.

13.—The skirt hooks may be attached by any suitable means.

14.—The skirt hooks may be mounted at any suitable angle, or at any suitable location relative to that of the horizontal bar, or the ends of the hanger arms.

15.—All hanger materials may be either a mixture of any suitable types, or of the same type.

16.—The hanger body may be of any suitable size, shape and geometric cross-section. A hole, or holes, of any size and shape may also be incorporated into the body for lightness, styling and economy of material.

17.—The hanger arms may be of any suitable size, shape, length and geometric cross-section. A hole, or holes, of any size and shape may also be incorporated into the arms for lightness, styling and economy of material.

18.—The hanger may be drilled, machined, stamped, pressed, milled, etched, tapped, threaded or molded as necessary for the attachment of necktie hoop, collar retention clip, bar, skirt hooks and hanger hook.

19.—The hanger may be manufactured by any suitable means, inclusive of injection molding and casting processes.

20.—The hoop and collar retention clip may be mounted at any convenient location on the appropriate side of the hanger face.

21.—The hanger, all parts, and appendages, may be of any desired color.

22.—The necktie hoop, collar retention clip and skirt hooks may be used collectively, individually, or in any combination thereof; on any given hanger.

OPERATION OF INVENTION

The invention is used as a support mechanism for the organization of clothing garments. The invention is such that when garments with a collar are placed over the wings of the invention, the collar of such garments is tucked between the body of the hanger and the collar retention clip. Accessory garments such as scarves, ties and belts are then attached to the invention using the loop provided for such action.

DESCRIPTION AND OPERATION OF ALTERNATIVE EMBODIMENTS

Although the present invention has been illustrated and described with reference to the preferred embodiment thereof, it should be understood that it is in no way limited to the details of such embodiment but is capable of numerous modifications within the scope of the appended claims.

What is claimed is:

1. A garment hanger, comprising:

a main support;

a hook attached to said main support;

a retention clip formed onto the rear of said main support;

a hoop formed on front of said main support with a vertical opening; and wherein when said main support serves as the body upon which garments can be mounted.

2. A garment hanger according to claim 1, wherein said main support may be formed in such a way as to form hooks for the attachment of skirts via retention loops on said skirts.

3. A garment hanger according to claim 1, further comprising a bar for the hanging of pants or slacks.

4. A garment hanger according to claim 1, wherein said main support has a clip for retaining the collar of said garments.

5. A garment hanger according to claim 1, wherein said main support has a loop for the attachment of accessories.

* * * * *